US005944234A

United States Patent [19]

Lampe et al.

[11] Patent Number: 5,944,234

[45] Date of Patent: Aug. 31, 1999

[54] DISPENSING CLOSURE FOR PACKAGE CONTAINING A CONSUMABLE BEVERAGE

[75] Inventors: William H. Lampe, Marietta, Ga.; Jeffrey T. Randall, Oconomowoc; Christopher J. Wood, Wauwatosa, both of Wis.; Paul E. Brown, Midland; Timothy R. Socier, Essexville, both of Mich.

[73] Assignees: AptarGroup, Inc., Crystal Lake, Ill.; The Coca-Cola Company, Atlanta, Ga.

[21] Appl. No.: 09/010,074

[22] Filed: Jan. 21, 1998

[51] Int. Cl.[6] ..... B65D 5/72

[52] U.S. Cl. ..... 222/490; 222/494; 222/545; 222/546

[58] Field of Search ..... 222/212, 490, 222/494, 545, 546, 556

[56] References Cited

U.S. PATENT DOCUMENTS

| | | | |
|---|---|---|---|
| 4,171,749 | 10/1979 | Obrist et al. . | |
| 4,735,334 | 4/1988 | Abbott | 222/546 X |
| 4,872,571 | 10/1989 | Crecelius et al. . | |
| 4,993,606 | 2/1991 | Bolen, Jr. et al. . | |
| 5,115,950 | 5/1992 | Rohr . | |
| 5,213,236 | 5/1993 | Brown et al. . | |
| 5,271,531 | 12/1993 | Rohr et al. . | |
| 5,307,955 | 5/1994 | Viegas . | |
| 5,390,805 | 2/1995 | Bilani et al. . | |
| 5,551,608 | 9/1996 | Moore et al. . | |
| 5,626,262 | 5/1997 | Fitten et al. . | |
| 5,632,420 | 5/1997 | Lohrman et al. . | |
| 5,676,289 | 10/1997 | Gross et al. | 222/494 |
| 5,769,253 | 6/1998 | Gross | 222/556 X |
| 5,788,108 | 8/1998 | Rohr | 222/556 X |
| 5,797,523 | 8/1998 | Gross | 222/556 X |

FOREIGN PATENT DOCUMENTS

| | | |
|---|---|---|
| 0 323 370 | 12/1988 | European Pat. Off. . |
| 1 228 265 | 3/1959 | France . |
| 172 438 | 9/1952 | Germany . |
| 297 06 456 | 9/1998 | Germany . |
| 184447 | 8/1936 | Switzerland . |
| WO 97/08073 | 3/1997 | WIPO . |

OTHER PUBLICATIONS

Seaquist Closures—Drawing No. XDA–0543.
Seaquist Closures—Drawing No. CS–2053–0522–H.
"Sample closure marketed on Wesson™ Stir Fry Oil bottle".

*Primary Examiner*—Kevin P. Shaver
*Attorney, Agent, or Firm*—Alston & Bird LLP

[57] ABSTRACT

A sealing and dispensing closure for the outlet opening of a package, such as a flexible plastic bottle containing a consumable beverage. The closure comprises a closure base which is threaded onto the outlet opening of the bottle, and a removable overcap which is pivotally connected to the closure base. The closure base includes a spout having a self-sealing dispensing valve therein which is movable from a lowered closed position to a raised open position by an increased pressure in the bottle resulting from the squeezing of the bottle. The valve is positioned at a recessed location within the spout so as to preclude access to the valve by the consumer when the valve is lifted to its raised open position, and the overcap includes a post which seats in the upper end of the spout when the overcap is mounted on the closure base, and so as to form a hermetically sealed chamber above the valve which prevents the valve from lifting to its raised position in the event the bottle is inadvertently squeezed.

19 Claims, 3 Drawing Sheets

DISPENSING CLOSURE FOR PACKAGE CONTAINING A CONSUMABLE BEVERAGE

BACKGROUND OF THE INVENTION

The present invention relates to a closure for sealing the outlet opening of a package, such as a flexible plastic bottle, containing a consumable beverage or other liquid, and wherein the beverage may be dispensed through the closure by squeezing the package.

In the beverage industry, closures for packages such as bottles have typically been of the screw-on type, which are repeatedly removed and resealed when the contents of the bottle is to be poured out. Recently, however, an increasing number of package closures include dispensing valves that allow the contents to flow through the closure for consumption, without removal of the closure. The most widely used dispensing closure of this type is the pull-push dispensing closure, similar to that used on many liquid dishwashing soap packages.

The pull-push closure, however, has significant drawbacks when used with a beverage container. For example, the closure requires the user to manually pull the spout open and push it closed, which can contaminate the closure. Also, if the user does not close the spout, the package will leak, since the spout will remain open.

U.S. Pat. application Ser. No. 08/519,492, filed Aug. 25, 1995 discloses an improved closure of the described type and wherein a self-sealing dispensing valve is disposed in a spout of the closure, and such that the valve is moved automatically to a raised open position by the increased pressure in the bottle resulting from its being squeezed. The application also discloses an overcap which may be assembled to enclose the spout and prevent the valve from lifting to its open position. Further, the application discloses the use of an inner seal which sealably closes the outlet opening of the bottle and must be removed in order to be able to dispense the beverage from the bottle.

While the closure described in the above referenced application is seen to represent a significant improvement in the art, further improvements have been deemed desirable. It is accordingly and object of the present invention to provide a closure of the described type which includes additional advantages and improvements.

It is a more specific object of the present invention to provide a closure for a beverage containing package or bottle wherein the self-sealing dispensing valve is inaccessible to the consumer, so as to discourage tampering with or damage to the valve which could interfere with its ability to function properly.

It is also an object of the present invention to provide a closure of the described type which includes an overcap which may be removably mounted so as to cover and enclose the spout of the closure when the beverage is not being dispensed, and wherein the overcap and spout include a mating structure for more effectively precluding the movement of the valve to its raised open position when the bottle is inadvertently squeezed.

SUMMARY OF THE INVENTION

The above and other objects and advantages of the present invention are achieved by the provision of a sealing and dispensing closure which comprises a closure base adapted to be assembled to the outlet opening of the package, and which includes a tubular spout which is adapted to communicate with the outlet opening of the package and through which the liquid contained in the package is adapted to be dispensed. The spout includes an upper edge, and a self sealing dispensing valve is mounted within the spout and is movable by pressure within the package from a lower closed position to a raised open position. Also, the valve is mounted at a location along the height of the spout such that the valve is at least substantially completely spaced below the upper edge of the spout when the valve is in its raised open position. Thus the valve is inaccessible to the consumer while the liquid is being dispensed.

The closure as of the present invention also includes an overcap, and the overcap is connected to the closure base for selective movement between a covering position enclosing the spout of the closure base and a removed position wherein the spout is exposed and the liquid may be dispensed therethrough. The overcap includes a central post which is positioned so as to be coaxially received in the spout when the overcap is in the covering position, and the post is sealed in the spout when the overcap is in the covering position and so as to provide a hermetically sealed space in the spout between the post and the valve which acts to prevent the valve from moving from its lower closed position to its raised open position. This prevents leakage when the overcap is in its covering position, in the event the package is inadvertently squeezed.

The closure may further include an inner seal positioned within the internally threaded sleeve for engaging and sealably closing the outlet opening of the package when the closure is threadedly assembled thereon, such that the user of the container must first remove the closure from the outlet opening, and then remove the inner seal from the outlet opening, and then reassembly the closure, before the beverage can be dispensed.

BRIEF DESCRIPTION OF THE DRAWINGS

Some of the objects and advantages of the present invention having been stated, others will appear as the description proceeds, when considered in conjunction with the accompanying drawings in which.

DETAILED DESCRIPTION OF THE PREFERRED EMBODIMENT

Figure 1:
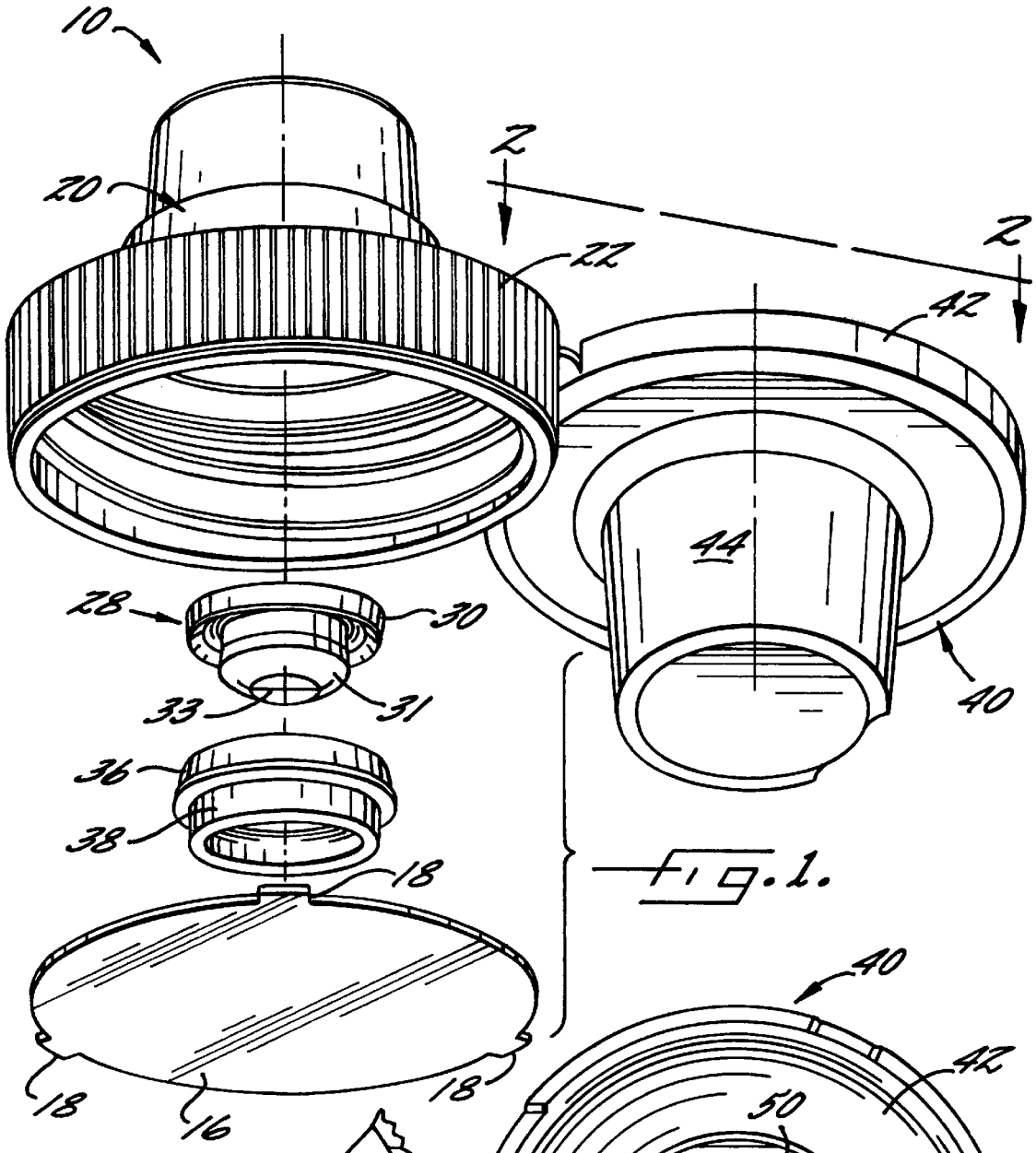
FIG. 1 is an exploded perspective view of a container closure which embodies the features of the present invention.
Figure 3:
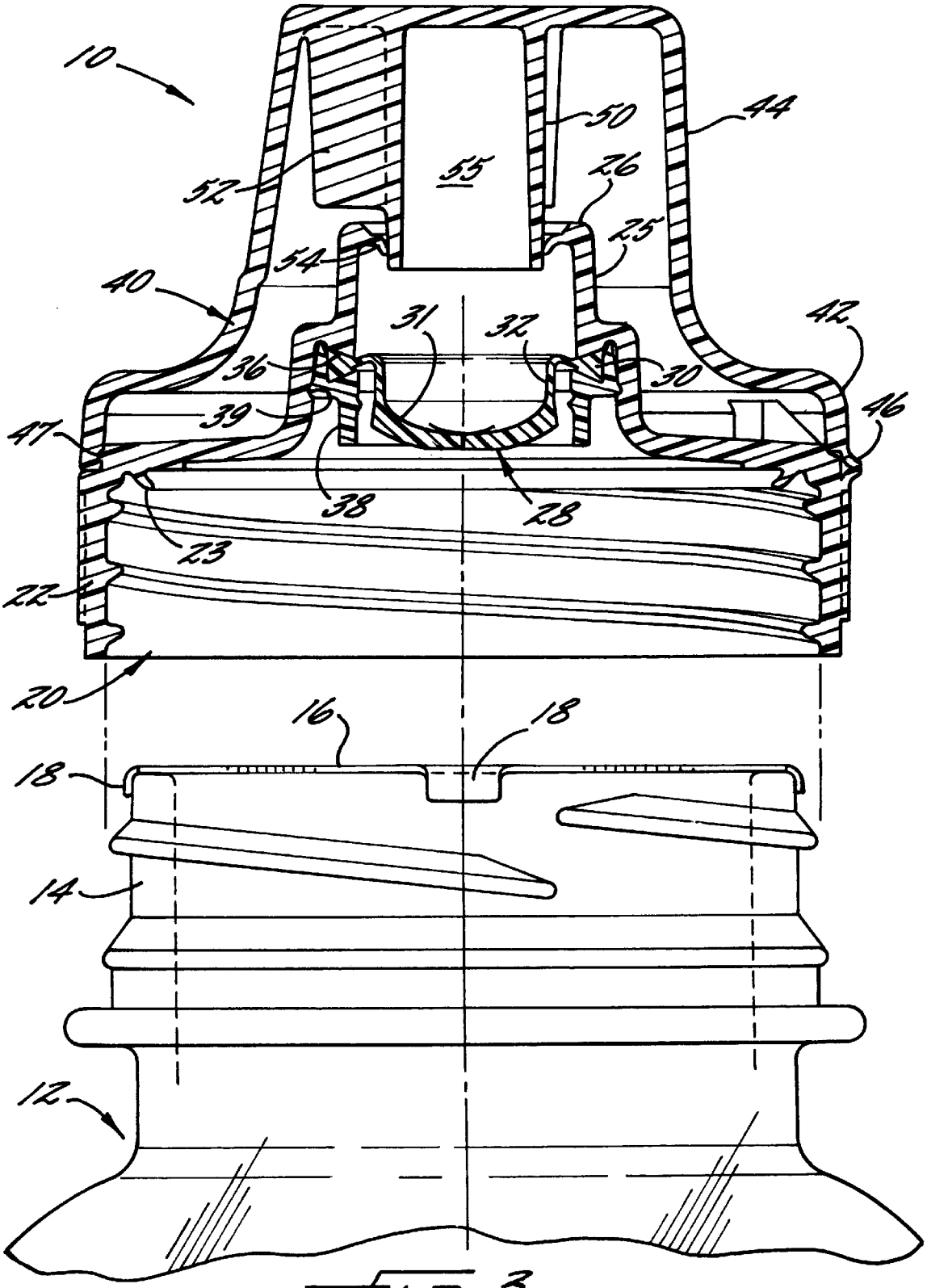
FIG. 3 is a partly sectioned side elevation view illustrating the closure in position to be assembled to the outlet opening of a bottle.
Figure 4:
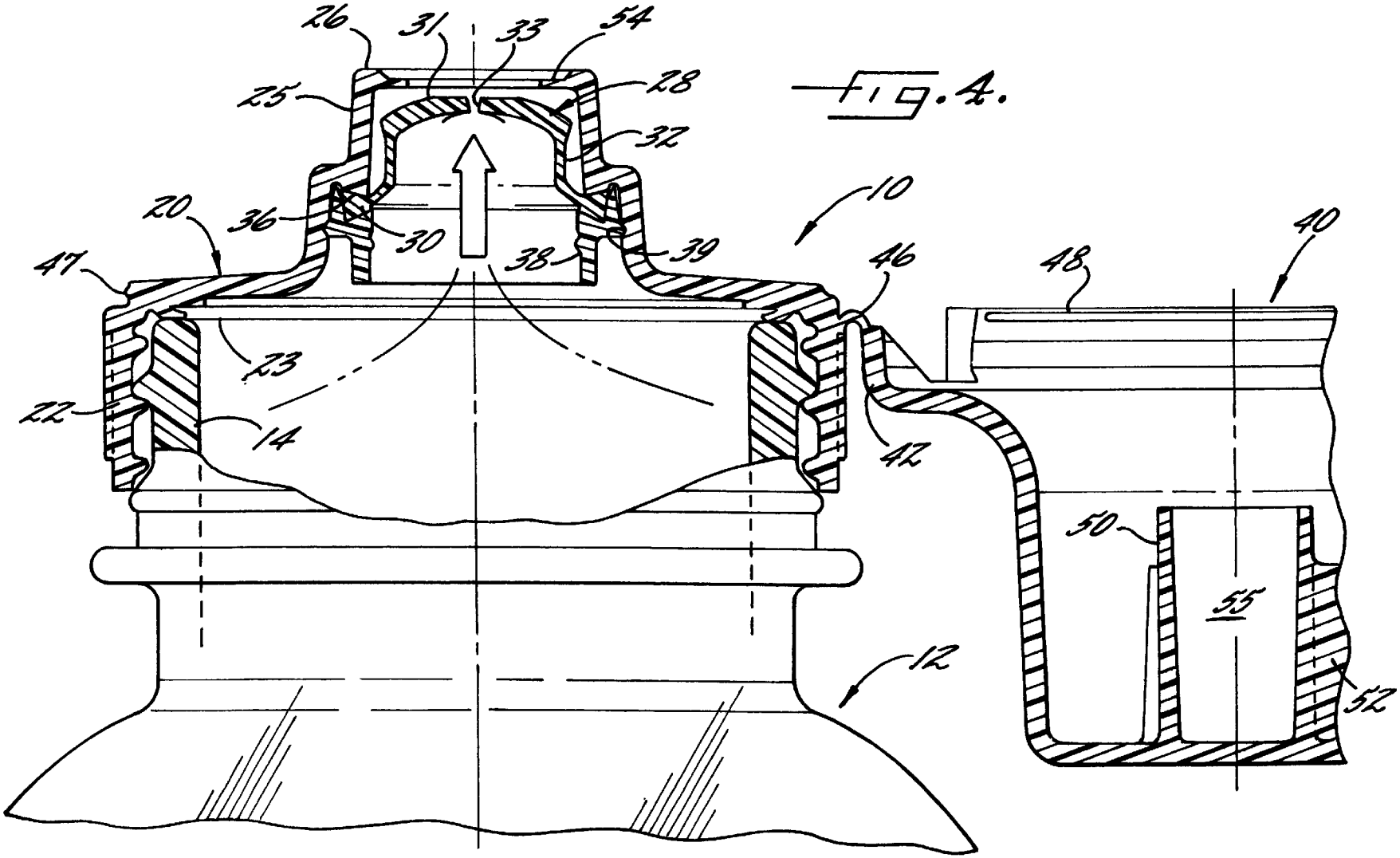
FIG. 4 is a view similar to FIG. 2 but illustrating the closure assembled to the bottle with the overcap pivoted to its removed positioned, and illustrating the effect of an increased pressure within the bottle and which causes the valve to lift to its raised open position and dispense the beverage contained in the bottle.

Referring more particularly to the drawings, FIG. 1 illustrates a closure 10 which embodies the features of the present invention, and which is adapted to be assembled to a conventional flexible plastic bottle 12 or other consumer package, to form a sealed container which typically contains a consumable beverage. As seen in FIGS. 3 and 4, the bottle 12 includes an externally threaded tubular outlet opening 14 or "finish", to which the closure is threadedly assembled in the manner further described below.

The closure 10 includes an inner seal 16, which is sealed to the outlet opening 14 of the bottle 12 by a conventional induction heating process or the like. With an induction seal, a hermetic, vacuum retaining seal can be provided for maintaining the integrity of the beverage. The inner seal 16 also eliminates the possibility of leakage during distribution and storage of the container. Further, the inner seal 16 prevents the beverage in the bottle from coming into contact with the dispensing valve of the closure as further described below, until the seal 16 is removed. To facilitate removal, the seal 16 may include suitable pull tabs 18, as is conventional.

The closure 10 further includes a closure base 20 having an internally threaded sleeve 22 which is threadedly joined to the outlet opening 14 of the bottle. A flexible annular sealing rib 23 is formed in the interior of the sleeve 22 at the base of the internal threads, for the purpose set forth below. The closure base 20 also includes a tubular spout 25 which communicates with the outlet opening 14 of the bottle and through which the beverage contained in the bottle is adapted to be dispensed. The spout 25 is of substantial vertical height, and it includes an upper edge 26.

A self-sealing dispensing valve 28 is mounted within the spout at medial location along the vertical height of the spout 25. The valve 28 may be of the type disclosed, for example, in U.S. Pat. Nos. 5,213,236 and 5,271,531, the disclosures of which are incorporated herein by reference, and the valve 28 comprises an outer flange 30 which is joined to a central body 31 by means of a flexible peripheral web 32. The central body 31 includes transverse slits 33, and the valve is normally self-biased to a lower closed position as seen in FIG. 3, so that the slits 33 (and valve) are closed. Upon the generation of a pressure below the valve, the central body 31 lifts or extends to a raised position as seen in FIG. 4 causing the slits 33 (and valve) to open. In the illustrated specific embodiment, the central body 31 normally assumes an inwardly concave configuration in its lower closed position as seen in FIG. 3, and it inverts to an outwardly convex configuration in its raised position as seen in FIG. 4.

As will also be seen, the valve 28 is disposed at a sufficient distance below the upper edge 26 of the spout 25 such that the valve is spaced below the upper edge when the valve is lifted to its raised open position. This positioning of the valve within the spout prevents access to the valve by the consumer, thus preventing any possible tampering with or damage to the valve.

The self-sealing dispensing valve 28 allows the beverage to be dispensed from the bottle 12 by increasing the pressure within the bottle, for example, by squeezing the bottle. Once the pressure is released, the valve automatically returns to its lower closed position, thus preventing leakage.

The self-sealing dispensing valve 28 is retained in the spout with its flange 30 seated against an annular internal shoulder 36 in the spout 25. Also, the underside of the flange 30 is supported by means of a retaining ring 38, which seats with a snap fit in an annular groove 39 in the spout and which is located immediately below the shoulder 36.

The closure 10 of the present invention also includes an overcap 40, which is in the form of an annular rim 42 which merges into a central dome 44. The rim 42 of the overcap is pivotally connected to the closure base 20 by means of a flexible flap 46, for selective movement between a covering position (FIG. 3) wherein the dome 44 encloses the spout 25 of the closure base 20, and a removed position (FIG. 4) wherein the spout 25 is exposed and the liquid may be dispensed therethrough. Preferably, the closure base 20, the overcap 40, and the connecting flap 46 are integrally molded of a suitable plastic material, such as polypropylene.

The closure base 20 includes an external lip 47 at the upper edge above the threaded sleeve 22 on the side opposite the flap 46, and which is engaged by a peripheral ridge 48 in the interior of the rim 42 of the overcap, so as to releasably hold the overcap in the covering position. The overcap may be readily released and pivoted to the removed position, by laterally pressing on the dome 44 of the overcap.

Figure 2:
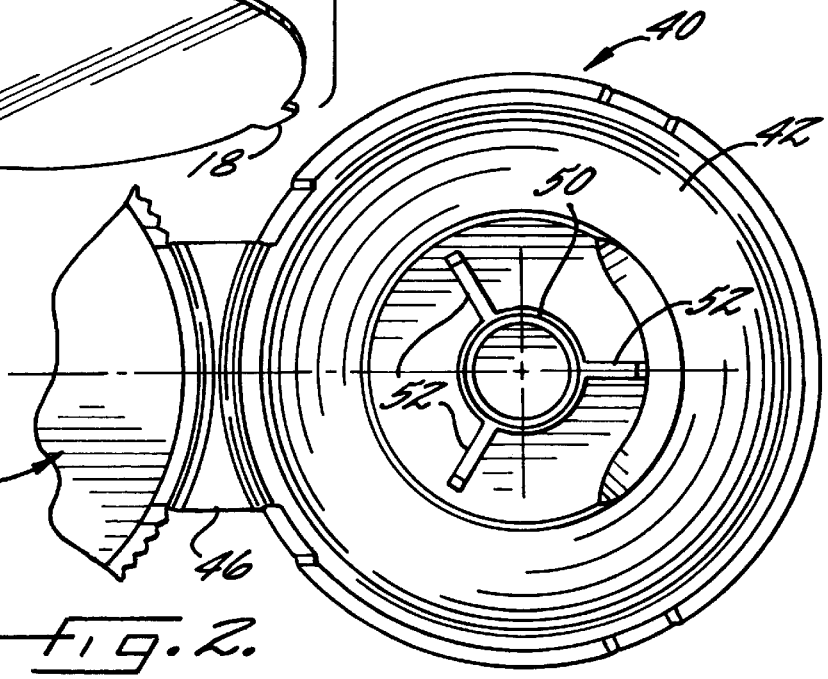
FIG. 2 is a plan view of the internal construction of the overcap of the closure, taken along the line 2—2 in FIG. 1.

The overcap 40 further includes a central post 50 which is positioned within the dome 44 and so as to be coaxially received in the upper portion of the spout 25 when the overcap is pivoted to the covering position. The post 50 is hollow to minimize the amount of the plastic material employed, and it is supported by three integral radial ribs 52, note FIG. 2. Further, the interior of the spout 25 includes a circumferential flexible sealing lip 54 which is adapted to engage the circumferential periphery of the post 50 when the overcap 40 is in its covering position, so as to provide a hermetically sealed space 55 (FIG. 3) in the spout 25 between the post 50 and the valve 28. This hermetically sealed space acts to prevent the valve from moving from its lower closed position to its raised open position.

To assemble the closure 10 to the outlet opening 14 of the bottle, the inner seal 16 may be initially mounted within the threaded sleeve 22 of the closure base 30 so as to be positioned immediately below the sealing rib 23. The closure is then threaded onto the bottle, causing the inner seal 16 to engage the upper edge of the opening 14. Alternatively, the seal 16 may be initially applied to cover the outlet opening 14 before the closure is assembled thereto.

Once the closure 10 is assembled on the bottle 12, the resulting container is passed under an induction sealer to induce current flow and therefor heat, within the aluminum layer of the induction seal 16. This heat causes a bonding between the sealing layer and the bottle opening, which maintains the integrity of the contents of the bottle.

In use, the consumer must first unscrew the closure 10 from the outlet opening 14, and remove the inner seal 16. The closure is then reassembled onto the outlet opening, causing the sealing rib 23 to sealably engage the upper surface of the outlet opening 14, note FIG. 4. When the beverage is to be dispensed, the overcap 40 is pivoted to its removed position by laterally pressing upon the dome 44 of the overcap. Upon squeezing the bottle 12, the resulting pressure increase in the bottle causes the valve 28 to lift to its raised open position (FIG. 4), and the beverage is dispensed through the spout 25. Upon release of the bottle, the internal pressure returns to normal, and the valve 28 automatically returns to its lower closed position.

In the drawings and specification, there has been set forth a preferred embodiment of the invention, and although specific terms are employed, they are used in a generic and descriptive sense only and not for purposes of limitation.

That which is claimed is:

1. A sealing and dispensing closure for an outlet opening of a package containing a consumable beverage or other liquid, and comprising a closure base adapted to be assembled to the outlet opening of the package, said closure base including an internally threaded sleeve which has a predetermined axial height, and a tubular spout extending axially outwardly from the sleeve a substantial distance, with said spout being configured to communicate with the outlet opening of the package and through which the liquid contained in the package is adapted to be dispensed, said spout including an upper edge, and a self sealing dispensing valve mounted within said spout and being movable by pressure within the package from a lower closed position to a raised open position, and said valve being mounted at a location along the height of the spout such that the valve is at least substantially completely spaced below the upper edge of the spout when the valve is in its raised open position so as to effectively prevent access to the valve by the consumer.

2. The closure as defined in claim 1 further comprising an overcap, said overcap being configured for selective movement between a covering position mounted on the closure base and enclosing the spout of the closure base and a removed position wherein the spout is exposed and the liquid may be dispensed therethrough.

3. The closure as defined in claim 2 wherein said overcap includes a central post which is positioned so as to be coaxially received in the spout when the overcap is in the covering position.

4. The closure as defined in claim 3 further comprising sealing means for sealing the post in the spout when the overcap is in the covering position and so as to provide a hermetically sealed space in the spout between the post and the valve which acts to prevent the valve from moving from its lower closed position to its raised open position.

5. The closure as defined in claim 4 wherein the sealing means comprises a circumferential flexible lip integrally joined to the spout for engaging the circumferential periphery of the post when the overcap is in its covering position.

6. The closure as defined in claim 5 further comprising a circumferential seal positioned in the internally threaded sleeve of the closure base for sealably engaging the outlet opening of the package when the closure is threadedly assembled thereon.

7. The closure as defined in claim 6 further comprising an inner seal positioned within said internally threaded sleeve for engaging and sealably closing the outlet opening of the package when the closure is threadedly assembled thereon.

8. The closure as defined in claim 4 wherein said overcap is integrally connected to said closure base by means of a flexible flap formed between said closure base and said overcap so that said overcap is pivotable between said covering position and said removed position.

9. The closure as defined in claim 8 wherein said closure base, said overcap, and said connecting flap are integrally molded of a plastic material.

10. The closure as defined in claim 1 wherein said spout extends axially outwardly from the sleeve a distance which is at least about one half the predetermined axial height of the internally threaded sleeve.

11. The closure as defined in claim 10 wherein the spout has a diameter which is substantially less than the diameter of the threaded sleeve, and wherein the spout is coaxially joined to the threaded sleeve by means of a generally flat annular flange.

12. A container for a consumable beverage or other liquid and comprising a flexible plastic bottle, said bottle including an externally threaded tubular outlet opening, a closure for selectively closing the outlet opening of the bottle and comprising (a) a closure base having an internally threaded sleeve threadedly joined to the outlet opening of the bottle, said closure base including a tubular spout which extends axially outwardly from the sleeve and which communicates with the outlet opening of the bottle and through which the liquid contained in the bottle is adapted to be dispensed, said spout having a substantial vertical height and including an upper edge, (b) a self sealing dispensing valve mounted within said spout and being movable by pressure within the bottle from a lower closed position to a raised open position, and said valve being mounted at a medial location along the vertical height of the spout such that the valve is at least substantially completely spaced below the upper edge of the spout when the valve is in its raised open position so as to effectively prevent access to the valve by the consumer, and (c) an overcap configured for selective movement between a covering position mounted on the closure base and enclosing the spout of the closure base and a removed position wherein the spout is exposed and the liquid may be dispensed therethrough by squeezing the bottle which increases the pressure in the bottle which in turn causes the valve to move to its raised open position.

13. The container as defined in claim 12 wherein said overcap includes a central post which is positioned so as to be coaxially received in the spout when the overcap is in its covering position, and further comprising sealing means for sealing the post in the spout when the overcap is in the covering position and so as to provide a hermetically sealed space in the spout between the post and the valve which acts to prevent the valve from moving from its lower closed position to its raised open position.

14. The closure as defined in claim 13 wherein the sealing means comprises a circumferential flexible lip integrally joined to the spout for engaging the circumferential periphery of the post when the overcap is in its covering position.

15. The closure as defined in claim 14 wherein said overcap is integrally connected to said closure base by means of a flexible flap formed between said closure base and said overcap so that the overcap is pivotable between said covering position and said removed position.

16. The closure as defined in claim 15 wherein said closure base, said overcap, and said connecting flap are integrally molded of a plastic material.

17. The closure as defined in claim 16 further comprising an inner seal positioned within said internally threaded sleeve and sealably closing the outlet opening of the bottle, such that the user of the container must first remove the closure from the outlet opening of the bottle, then remove the inner seal from the outlet opening of the bottle, and then re-assemble the closure, before the beverage can be dispensed.

18. The container as defined in claim 12 wherein said internally threaded sleeve has a predetermined axial height and wherein said spout extends axially outwardly from the sleeve a distance which is at least about one half the predetermined axial height of the internally threaded sleeve.

19. The container as defined in claim 18 wherein the spout has a diameter which is substantially less than the diameter of the threaded sleeve, and wherein the spout is coaxially joined to the threaded sleeve by means of a generally flat annular flange.

* * * * *